US007198567B2

(12) United States Patent
Casey

(10) Patent No.: US 7,198,567 B2
(45) Date of Patent: Apr. 3, 2007

(54) DESKTOP-TYPE VENTILATION SYSTEM

(76) Inventor: Gary M. Casey, 6346 Everwood Ct. N., East Amherst, NY (US) 14051

( * ) Notice: Subject to any disclaimer, the term of this patent is extended or adjusted under 35 U.S.C. 154(b) by 0 days.

(21) Appl. No.: 11/013,169

(22) Filed: Dec. 15, 2004

(65) Prior Publication Data

US 2006/0128297 A1 Jun. 15, 2006

(51) Int. Cl.
*B05C 15/00* (2006.01)

(52) U.S. Cl. ..... 454/49; 454/53

(58) Field of Classification Search ..... 454/49, 454/50, 53; 126/299 F, 299 R, 299 D
See application file for complete search history.

(56) References Cited

U.S. PATENT DOCUMENTS

| | | | | | |
|---|---|---|---|---|---|
| 3,049,069 | A | * | 8/1962 | Whiston et al. | 454/56 |
| 3,811,250 | A | * | 5/1974 | Fowler, Jr. | 96/422 |
| 3,941,040 | A | * | 3/1976 | Carlson | 454/56 |
| 4,040,042 | A | * | 8/1977 | Mayer | 454/340 |
| 4,852,468 | A | * | 8/1989 | Harris | 454/56 |
| 5,112,373 | A | * | 5/1992 | Pham | 96/142 |
| 5,170,673 | A | * | 12/1992 | Ahmed et al. | 73/865.9 |
| 5,232,152 | A | * | 8/1993 | Tsang | 236/44 A |
| 5,267,895 | A | * | 12/1993 | Mitchell et al. | 454/57 |
| 5,314,376 | A | * | 5/1994 | Kuramarohit | 454/186 |
| 5,882,254 | A | * | 3/1999 | Jacob | 454/61 |
| 6,080,058 | A | | 6/2000 | Coe et al. | |

OTHER PUBLICATIONS

"Portable Fume Hood", 2001, United Lab Equipment, Inc., at www.unitedlabequip.com, Nov. 24, 2004.
"Portable Fume Hoods, Work Stations and Filters", Atlantic Nuclear Corporation, Canton, MA, at www.atnuke.com, Nov. 24, 2004.
"Chemical Exhaust Hoods", Daniel Sarachick, at www.brown.edu, Nov. 23, 2004.
"Airguard—Fume Hood", 2003, New England Laboratory Casework Co., Inc., at www.nelcompanies.com, Nov. 23, 2004.
"Winged Sentry", 2001, Sentry Air Systems, Inc., Houston, TX, www.sentryair.com, Nov. 23, 2004.
"AirMax, Total Exhaust Fume Hoods", Air Clean Systems, www.aircleansystems.com, Nov. 23, 2004.

* cited by examiner

*Primary Examiner*—Derek S. Boles
(74) *Attorney, Agent, or Firm*—Simpson & Simpson, PLLC

(57) ABSTRACT

A desktop-type ventilation system generally includes a ventilation hub having at least one vent and at least one fume hood connected thereto. The fume hood(s) generally include a pair of side walls, wherein each is disposed at an angle for directing and causing air to be funneled toward the vent. The fume hood(s) include a front wall defining an inlet orifice, a rear wall having an outlet orifice for connection to the vent, and a top wall disposed at an angle of elevation from the rear wall to the front wall. The front wall is detachably securable to the side walls and the top wall such that the fume hood(s) may be broken down after use and nested for storage. The ventilation hub may detachably secure to a work surface such that it may be removed therefrom and conveniently stored when not in use.

6 Claims, 18 Drawing Sheets

DESKTOP-TYPE VENTILATION SYSTEM

FIELD OF THE INVENTION

The present invention relates to ventilation systems, and more particularly, to desktop-type ventilation systems.

BACKGROUND OF THE INVENTION

Fume hoods for removing fumes, vapors, potentially harmful gases, and particulates, etc., from laboratories, work areas and instructional type settings are fairly well known. Currently, most fume hoods comprise large, cabinet-type structures that are typically anchored in place. An example of an anchored type fume hood is generally disclosed in U.S. Pat. No. 6,080,058. Anchored type fume hoods generally comprise a plurality of flat, rectangular walls that form rectangular parallelepipeds. The front walls of these types of fume hood typically comprise a planar sash that may be raised and lowered to allow access to a work area. Typically, an area of low pressure is created within the cabinet structure by means of a fixed ventilation system, which draws air into the fume hood and evacuates any contaminated air out of the work area.

A problem with anchored fume hoods is that they are large, noisy, non-movable, obstructive and expensive. Because of their large size, anchored fume hoods are usually fixed in place and/or are placed in out of the way locations within a laboratories or classrooms. This can be problematic when laboratory or classroom instruction is required. For example, it can be difficult to assemble several individuals around an anchored fume hood in order to provide proper instruction. Also, the large size of the anchored fume hoods can block individuals' fields of vision/lines of sight during regular classroom instruction. Moreover, because they typically comprise small ventilation openings, anchored fume hoods usually require high fume hood velocities to effectively remove air from the work area; the high fume velocities typically create excessive noise. Additionally, because of their size and expense, only a limited number of anchored fume hoods may be affordable or be capable of being conveniently placed within a typical laboratory or classroom setting. As a result, the size and expense of anchored fume hoods can have the effect of limiting the number of individuals that may be safely present within a laboratory or classroom. While argument exists that it may be desirous to limit laboratory or class size and utilize large anchored fume hoods when extremely dangerous substances are used, in many instances, anchored fume hoods simply are not required. As a result, more compact, desktop-type fume hoods have been developed.

Current desktop-type fume hoods generally resemble anchored fume hoods in that they typically comprise a plurality of rectangular walls that form rectangular parallelepipeds; however, such devices are generally smaller and able of being placed on laboratory benches or desktops. The front walls of such compact desktop-type fume hoods typically comprise planar sashes that may be raised and lowered to allow access to a work area under the hood. The rectangular footprint of these fume hoods can make it difficult, from ergonomic standpoints, for individuals to work under the fume hood and/or they tend to limit and obstruct the work area. Additionally, the rectangular configuration of the fume hood tends to produce inefficient air flow into and out of the fume hood. Moreover, in many instances, such fume hoods are formed from plastics or other materials that may be highly reactive with several chemicals commonly used in laboratories and/or are prone to catching fire. Additionally, such compact, desktop-type fume hoods require separate ventilation ducts, or filtering devices, for each fume hood. Finally, known compact, desktop-type fume hoods cannot be broken down into smaller components after use for more convenient storage.

What is needed then is a compact and portable desktop-type ventilation system which overcomes these, and other, disadvantages.

SUMMARY OF THE INVENTION

The desktop-type ventilation system of the present invention broadly comprises a ventilation hub having at least one vent and at least one fume hood connected to the ventilation hub. The fume hood broadly comprises a pair of side walls, wherein each of the side walls is disposed at an angle for directing and causing air to be funneled toward the vent. In a preferred embodiment, the invention includes a front wall that defines an inlet orifice, a rear wall having an outlet orifice for connection to the vent, and a top wall disposed at an angle of elevation from the rear wall to the front wall. The front wall is detachably securable to the side walls and the top wall such that the fume hood may be broken down after use and conveniently stored. The ventilation hub is also detachably securable to a work surface such that it may be removed therefrom and conveniently stored.

It is therefore an object of the present invention to provide an improved desktop-type ventilation system.

It is another object of the present invention to provide a desktop-type ventilation system wherein one or more fume hoods may be detachably secured to a ventilation hub.

It is still yet another object of the invention to provide a desktop-type ventilation system having improved airflow.

It is an additional object of the present invention to provide a desktop-type ventilation system that may be broken down and stacked after use for efficient storage.

These and other objects, features, and advantages of the present invention will become readily apparent to those having ordinary skill in the art upon reading the following detailed description of the invention in view of the several drawings of the invention.

BRIEF DESCRIPTION OF THE DRAWINGS

The nature and mode of operation of the present invention will now be more fully described in the following detailed description of the invention in view of the accompanying drawing figures, in which.

DETAILED DESCRIPTION OF THE INVENTION

At the outset, it should be appreciated that while the present invention is described with respect to what is presently considered to be the preferred embodiments, the invention is not limited to the embodiments specifically recited herein. In the detailed description that follows like drawing numbers on different drawing views are intended to identify identical structural elements of the invention. The terms/phrases "desktop" and "desktop-type" as they relate to ventilation systems are intended to refer to ventilation systems, fume hoods, etc., that are compact, portable, and primarily configured for placement on desktops, benchtops, and similar work surfaces, etc.

Figure 1:
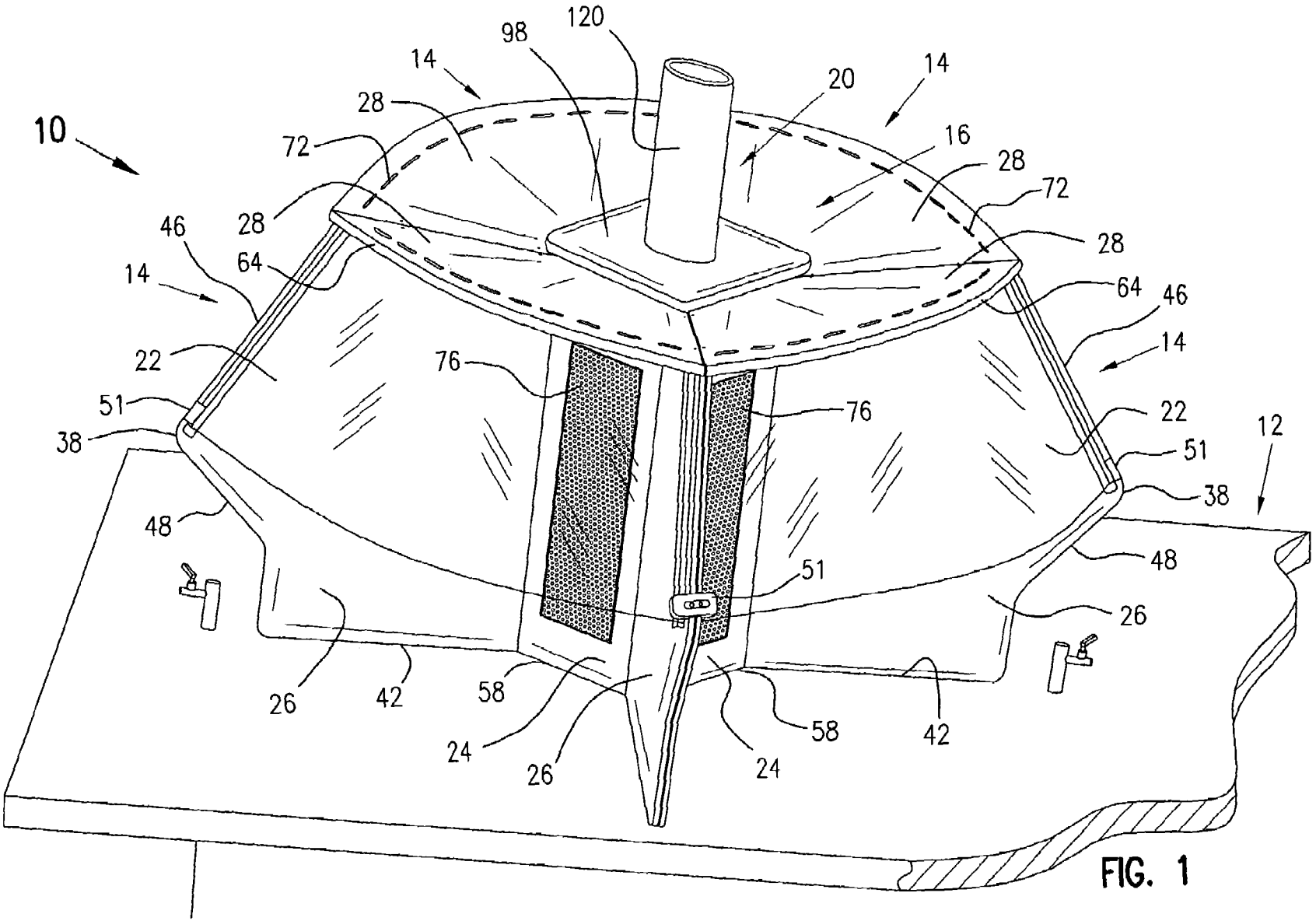
FIG. 1 is a perspective view of a desktop-type ventilation system according to the present invention.
Figure 2:
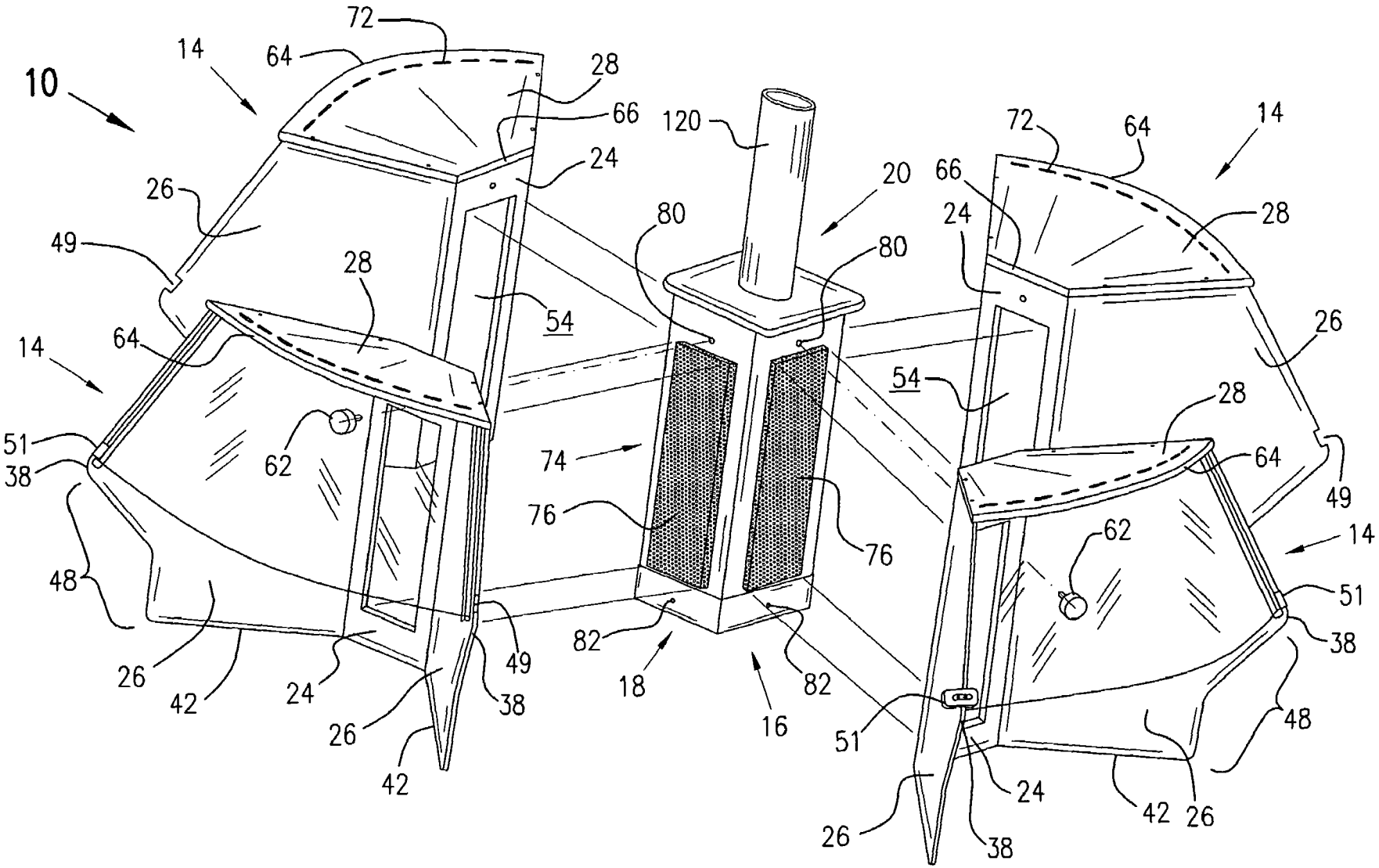
FIG. 2 is an exploded perspective view of a desktop-type ventilation system according to the present invention.
Figure 3:
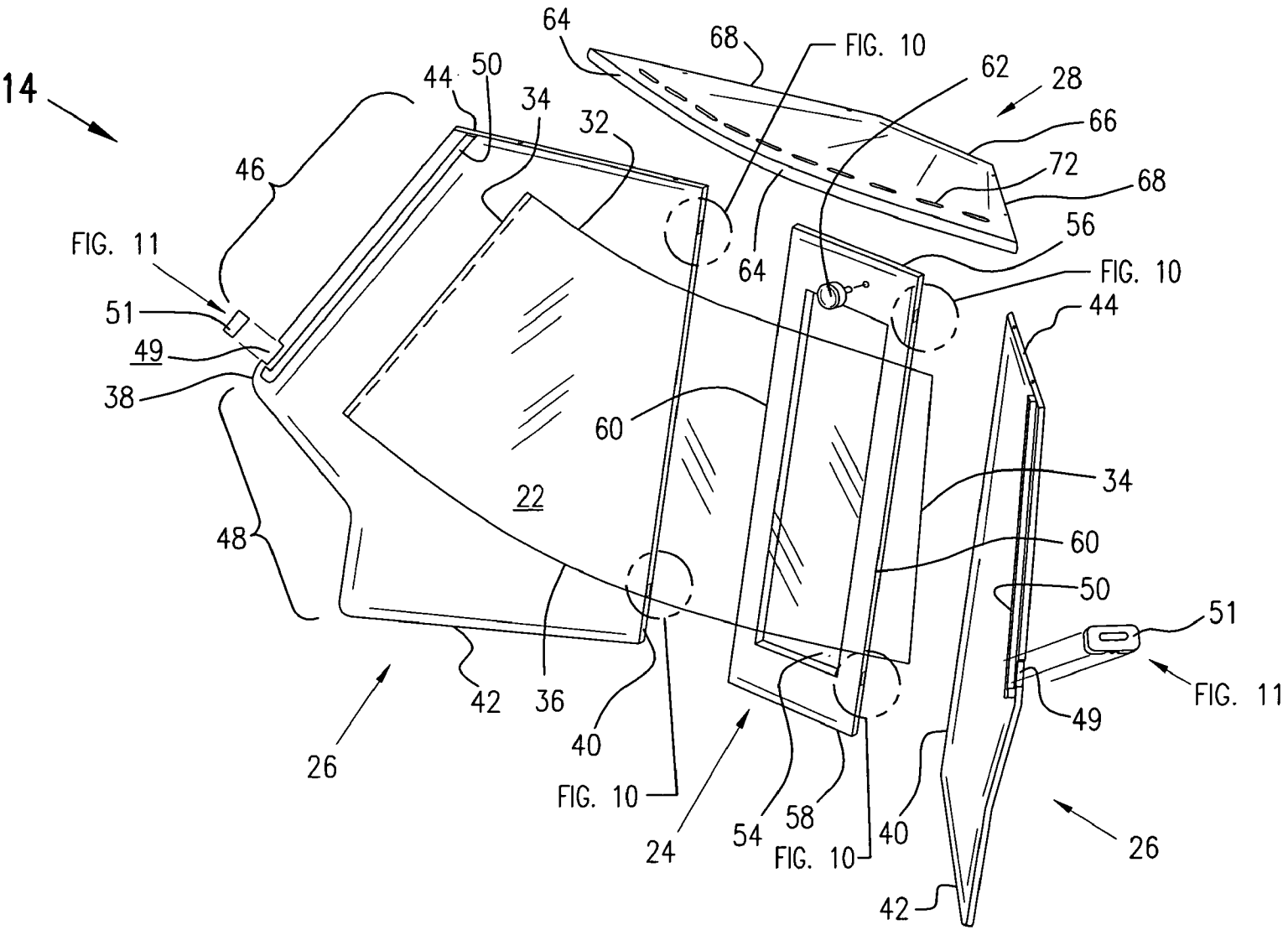
FIG. 3 is an exploded perspective view of a fume hood according to the present invention.
Figure 4A:
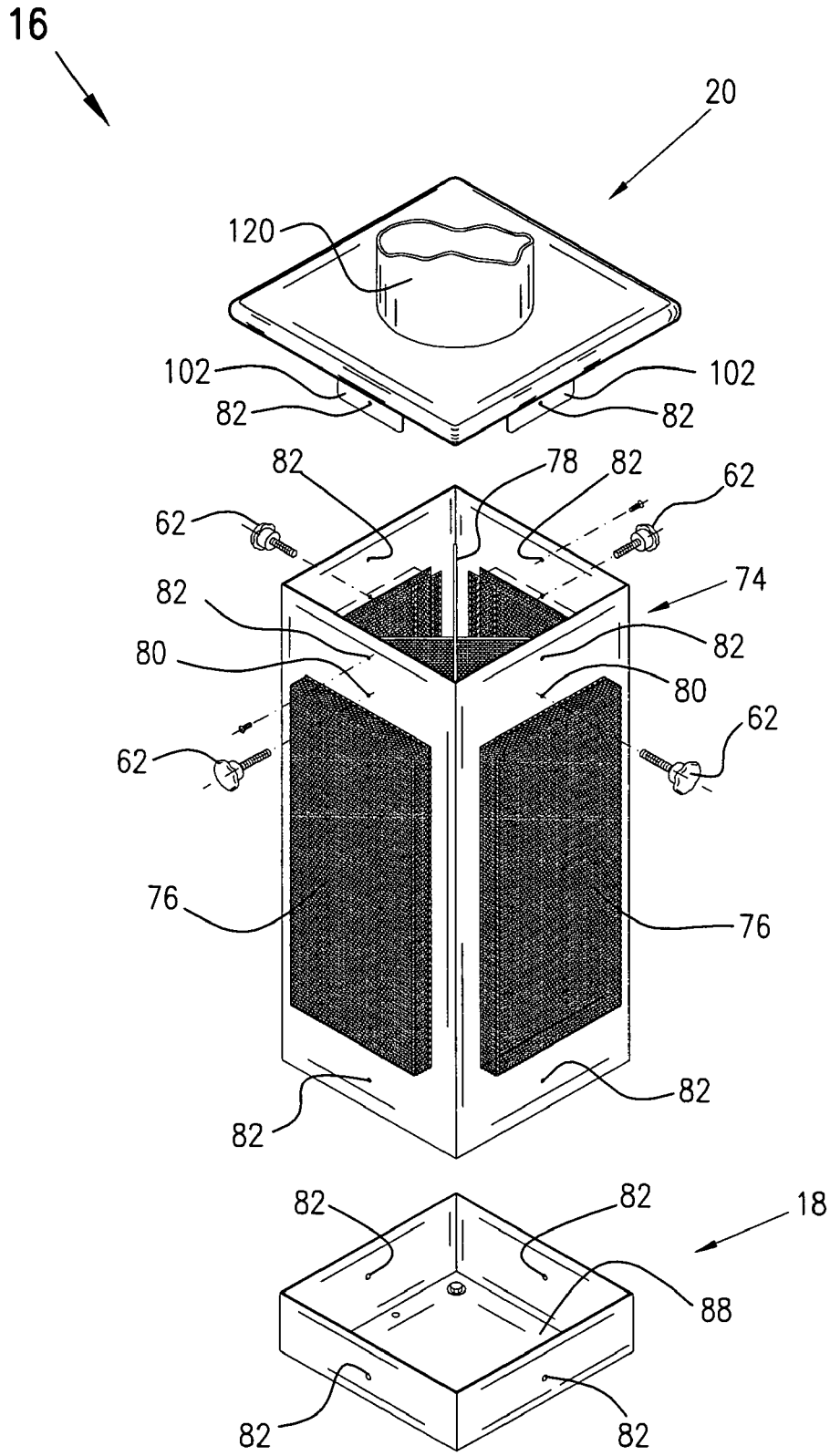
FIG. 4*a* is an exploded perspective view of a ventilation hub according to the present invention.
Figure 4B:
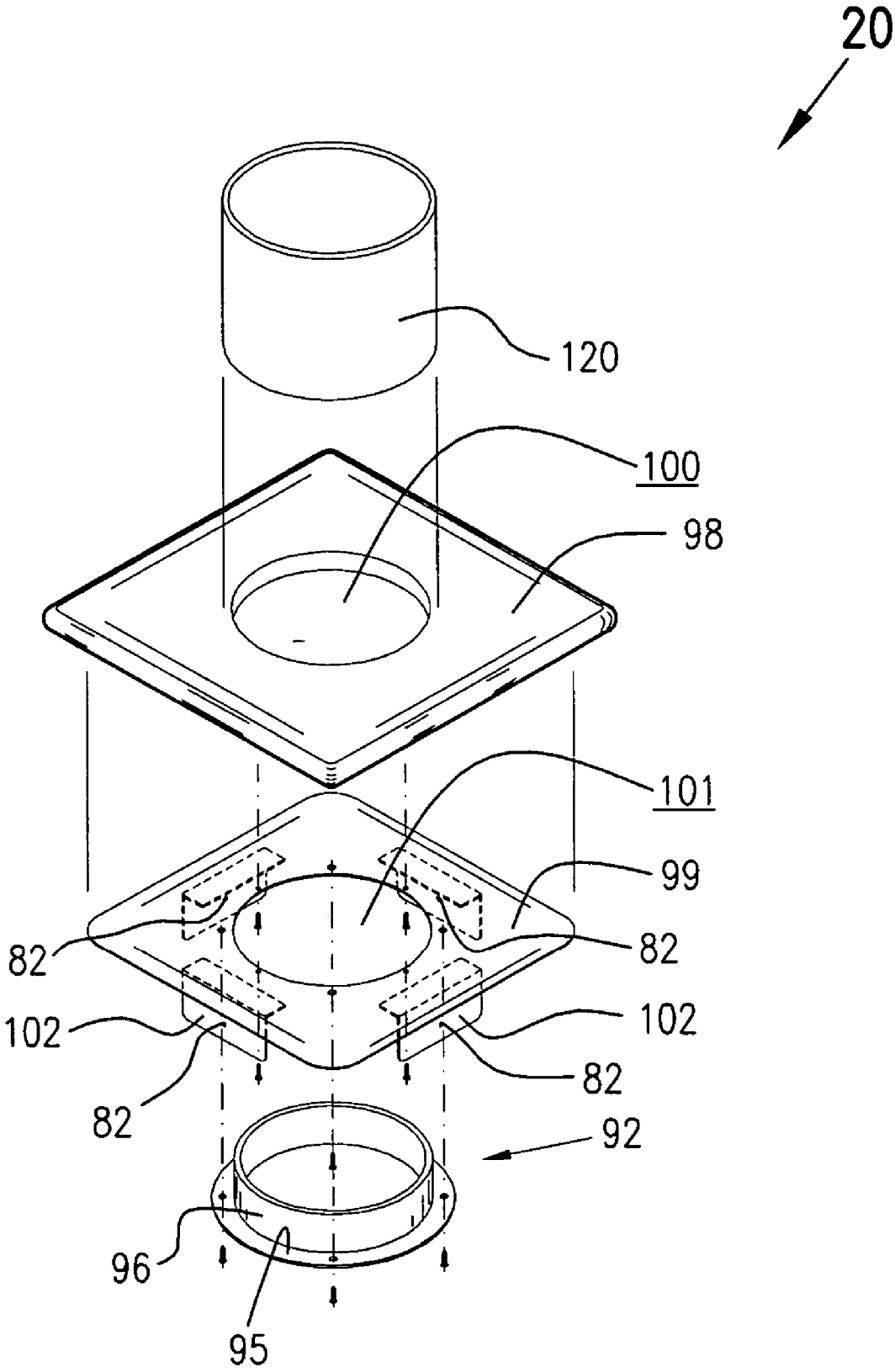
FIG. 4*b* is an exploded perspective view of an upper ventilation coupling according to the present invention.
Figure 4C:
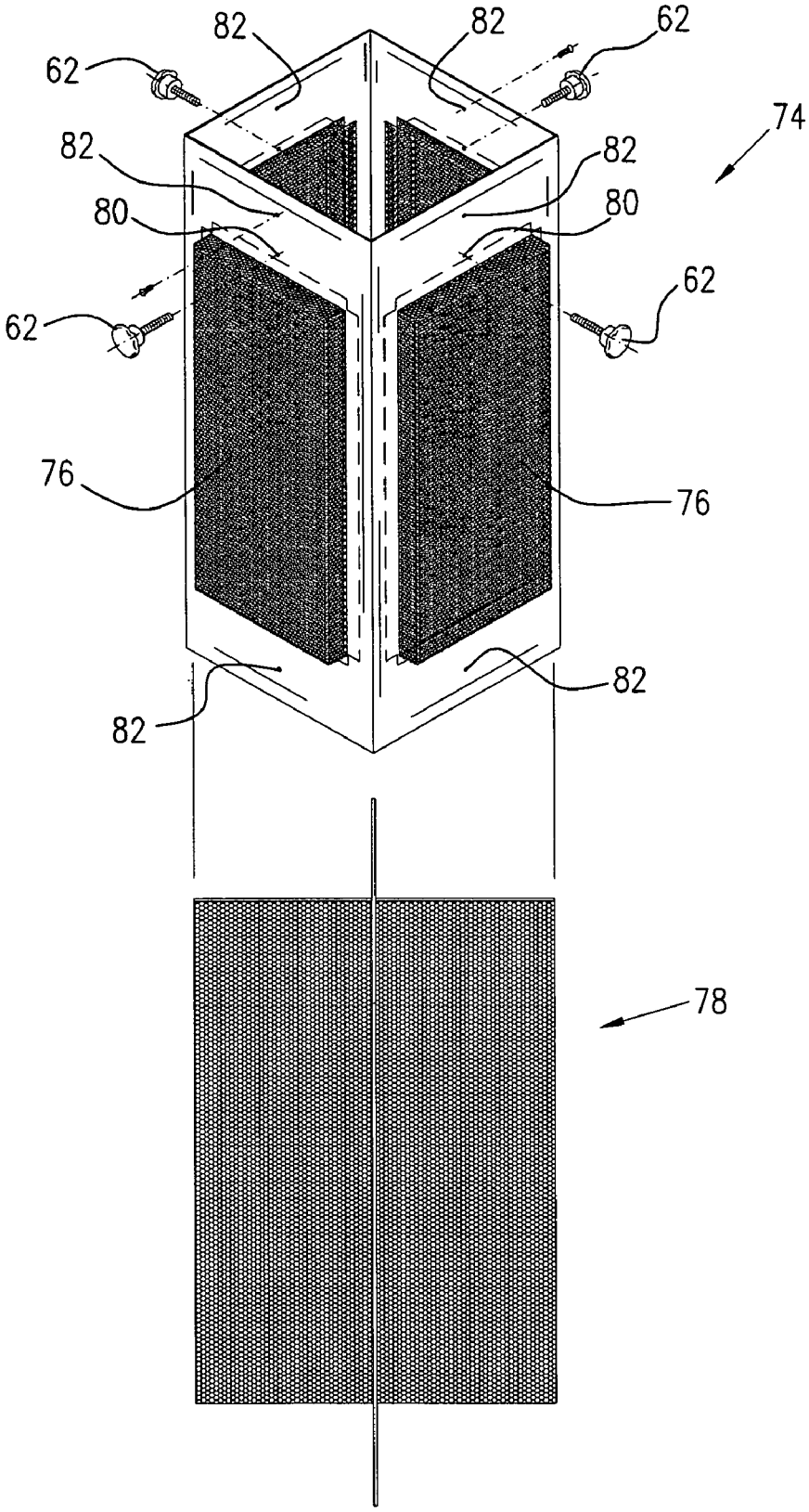
FIG. 4*c* is an exploded perspective view of a ventilation core according to the present invention.
Figure 5:
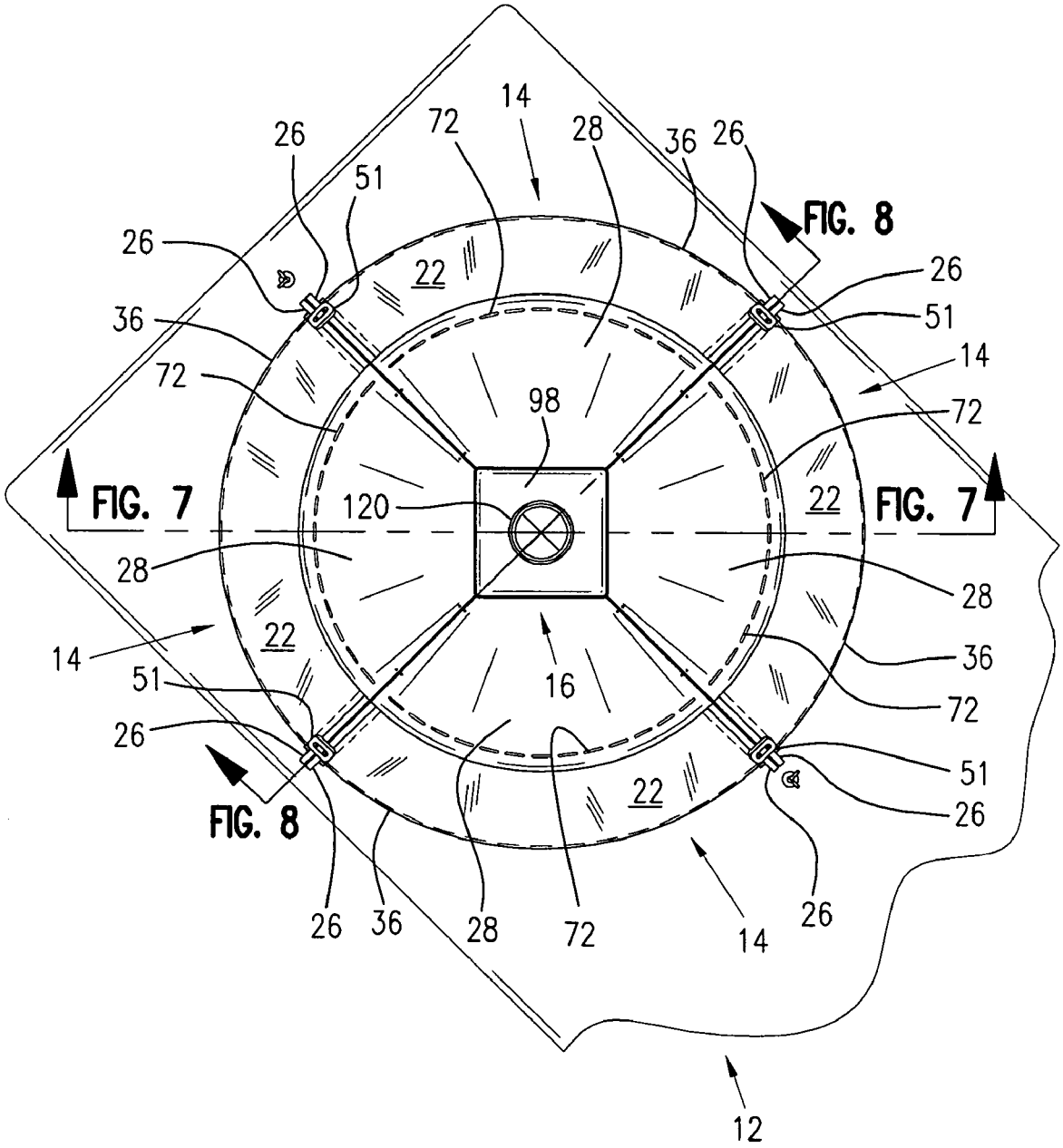
FIG. 5 is a top view of a desktop-type ventilation system according to the present invention.
Figure 6:
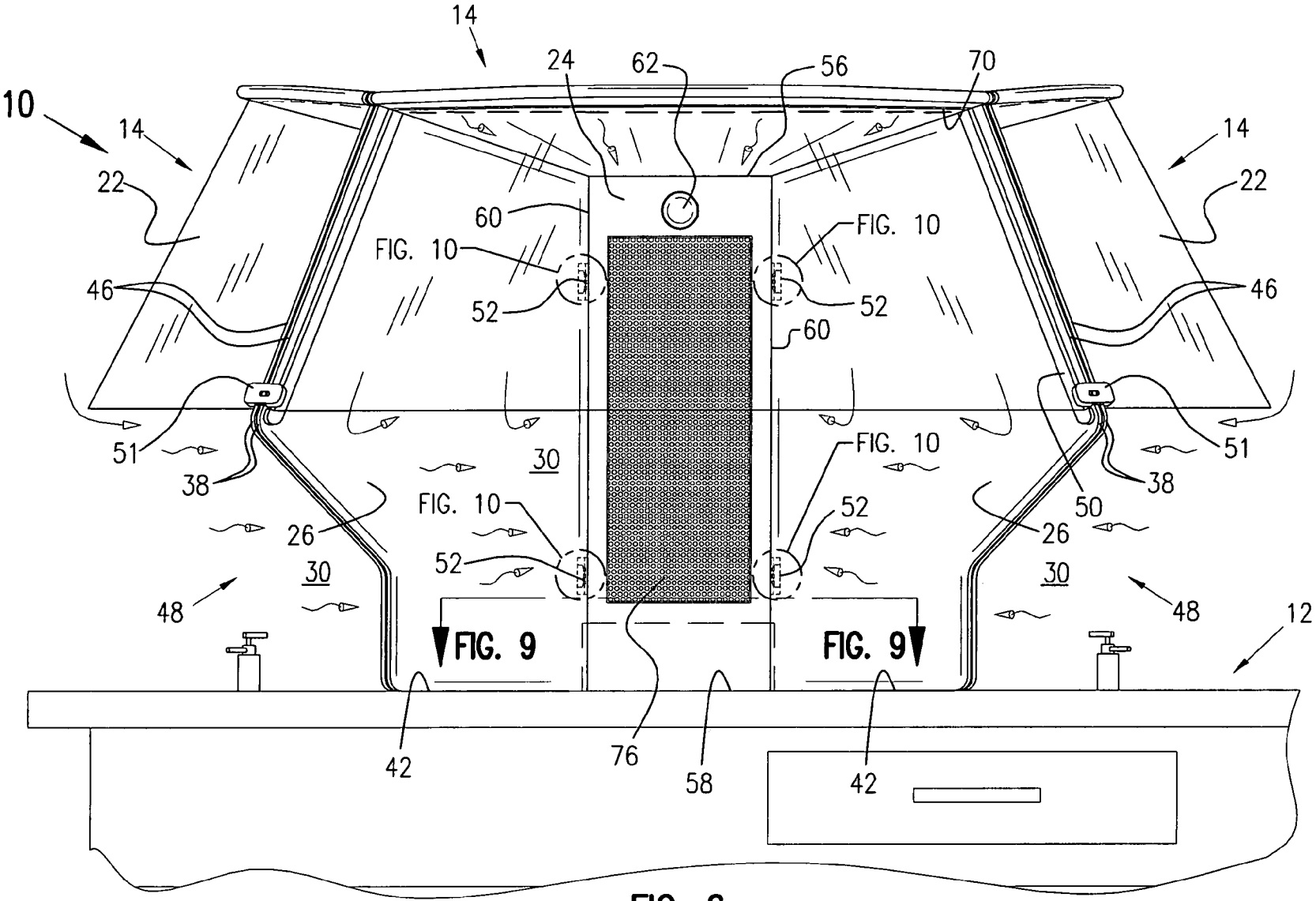
FIG. 6 is a front elevation view of a desktop-type ventilation system according to the present invention.
Figure 7:
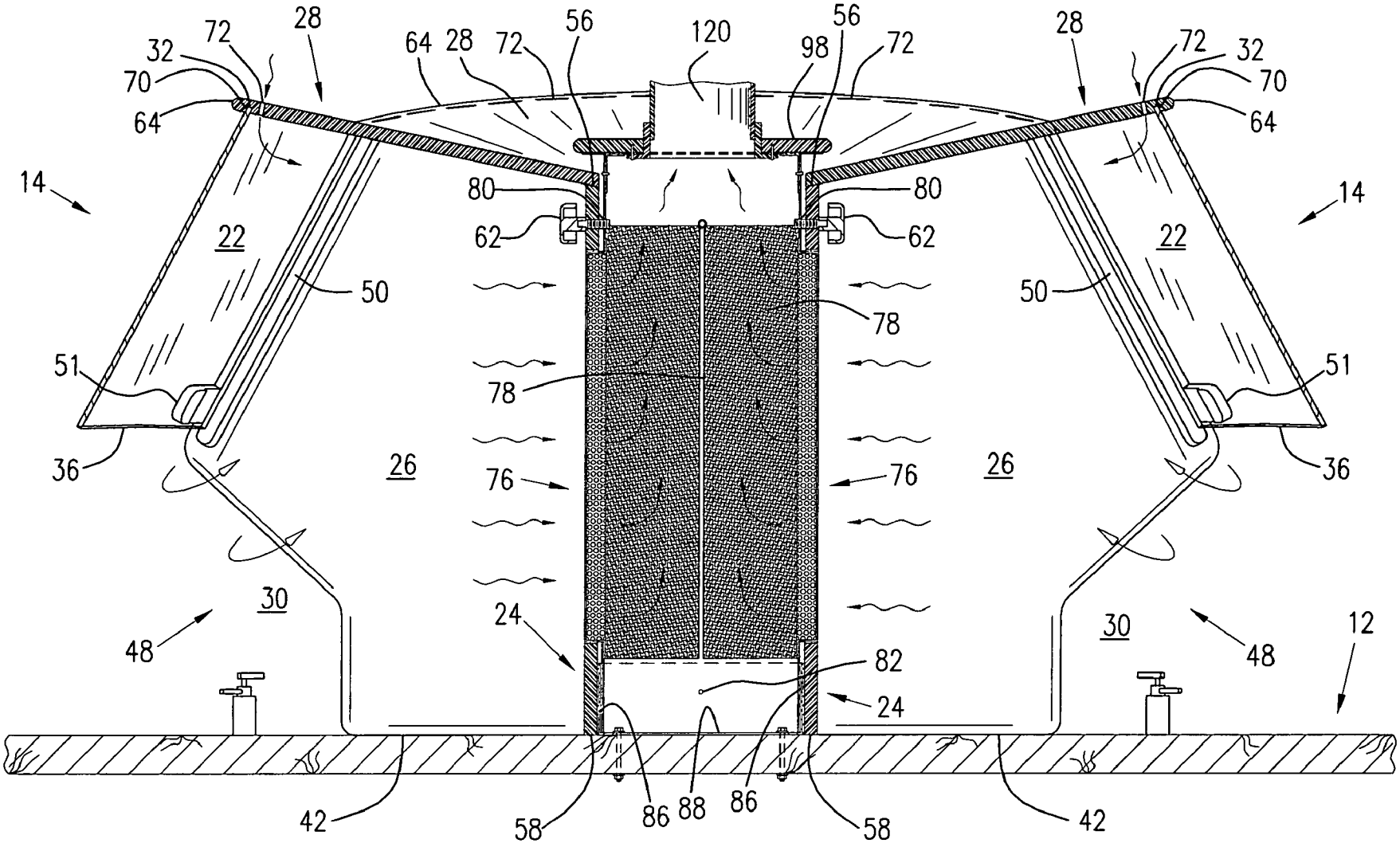
FIG. 7 is a sectional view of a desktop-type ventilation system according to the present invention taken generally along line 7—7 of FIG. 5, which illustrates the present invention connected to an overhead primary ventilation system.
Figure 8:
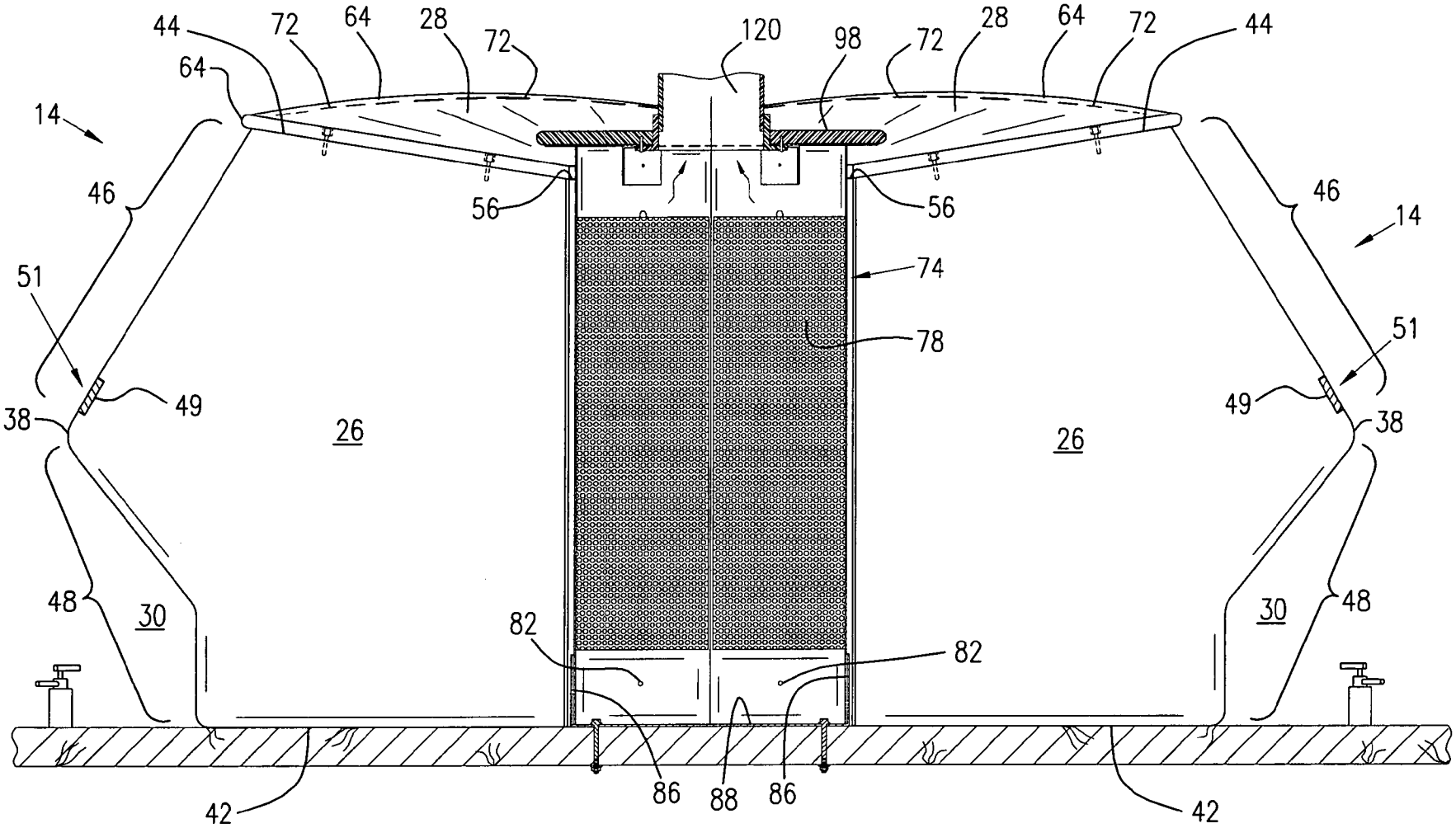
FIG. 8 is a sectional view of a desktop-type ventilation system according to the present invention taken generally along line 8—8 of FIG. 5, which illustrates the present invention connected to an overhead primary ventilation system.
Figure 9:
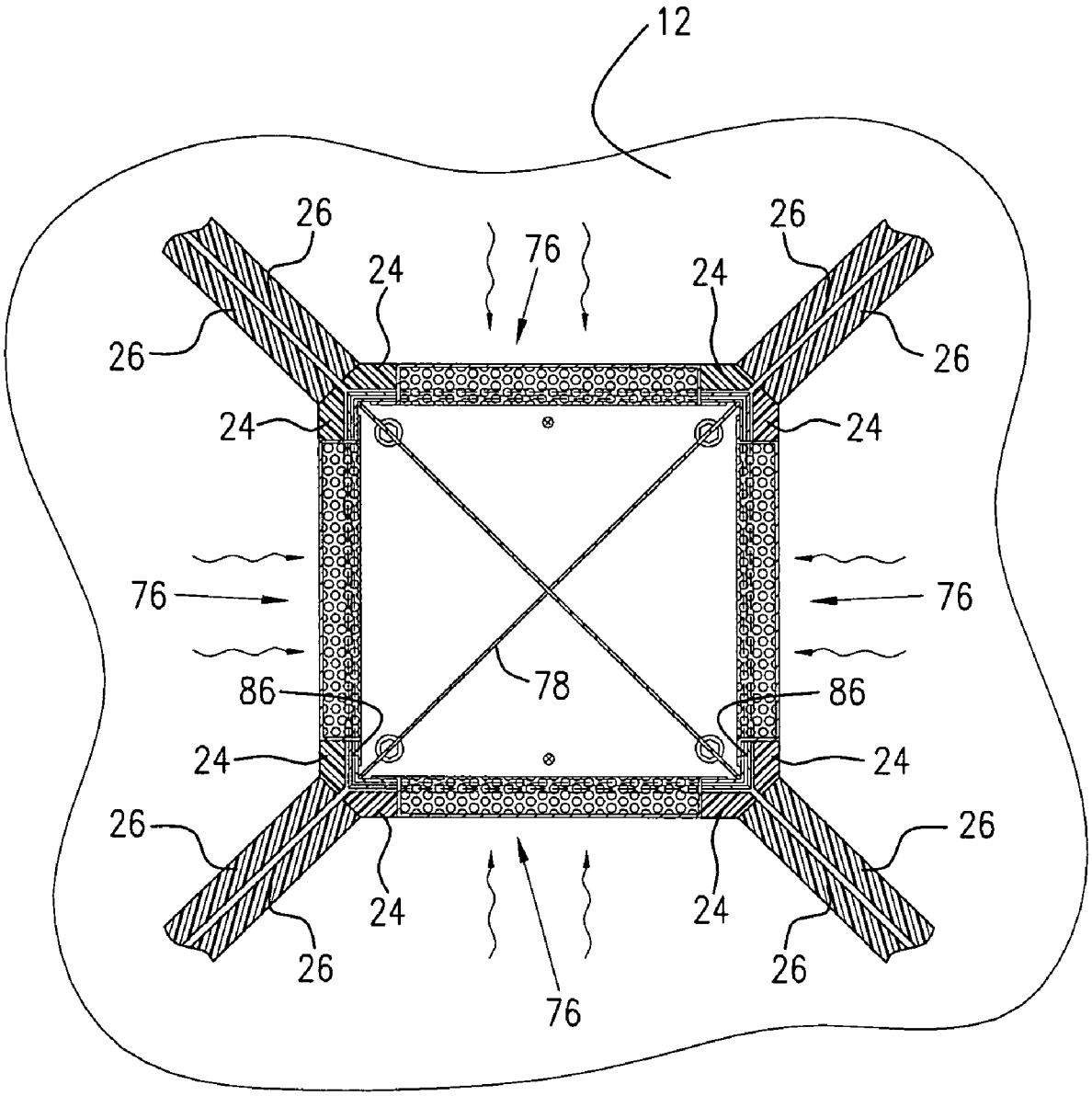
FIG. 9 is a sectional view of a desktop-type ventilation system according to the present invention taken generally along line 9—9 of FIG. 6.
Figure 10:
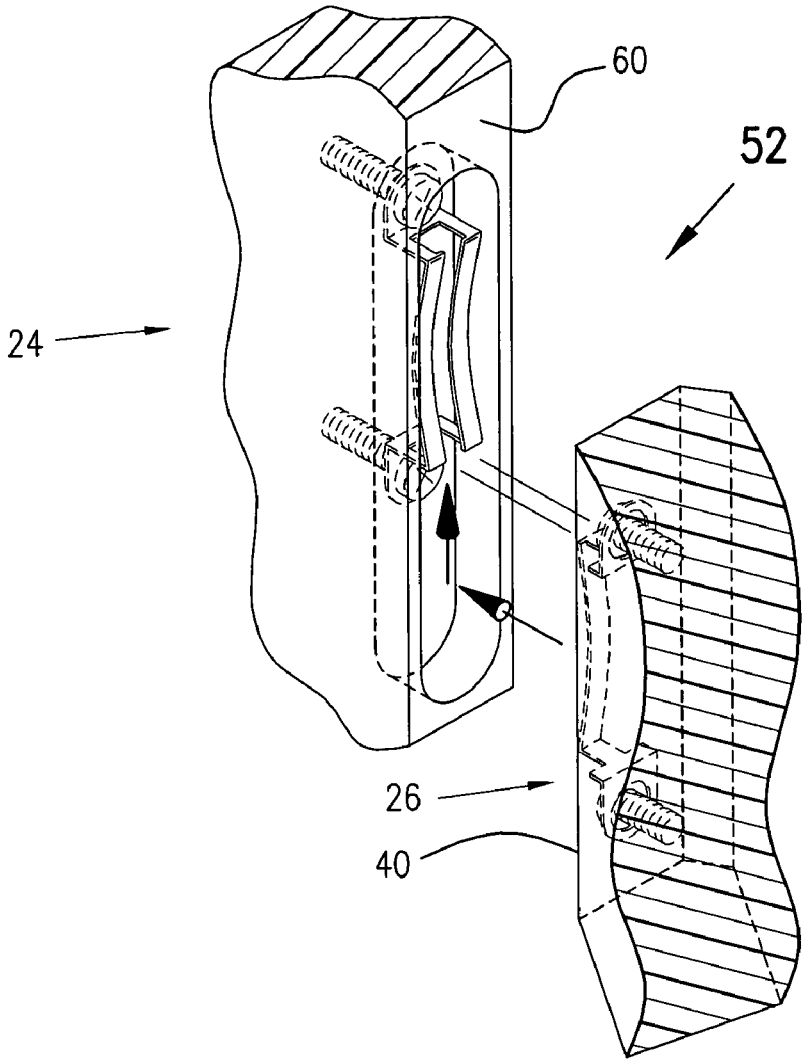
FIG. 10 is a detailed view of a mating fastener for fastening side and rear walls of the present invention.
Figure 11A:
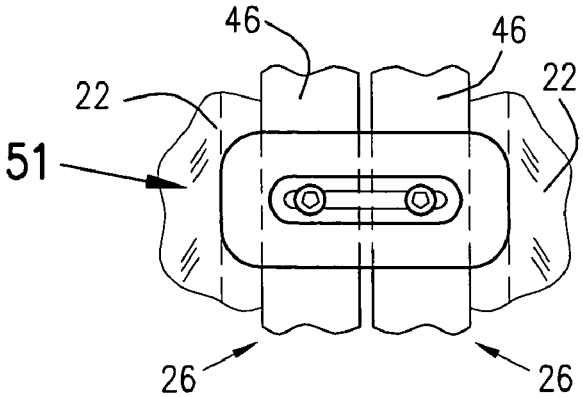
FIGS. 11*a* and 11*b* are front and top views, respectively, of a front wall fastener according to the present invention.
Figure 11B:
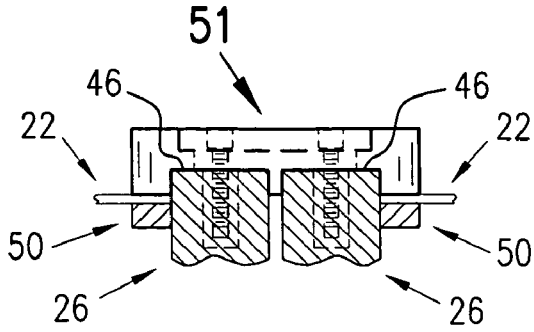
Figure 14:
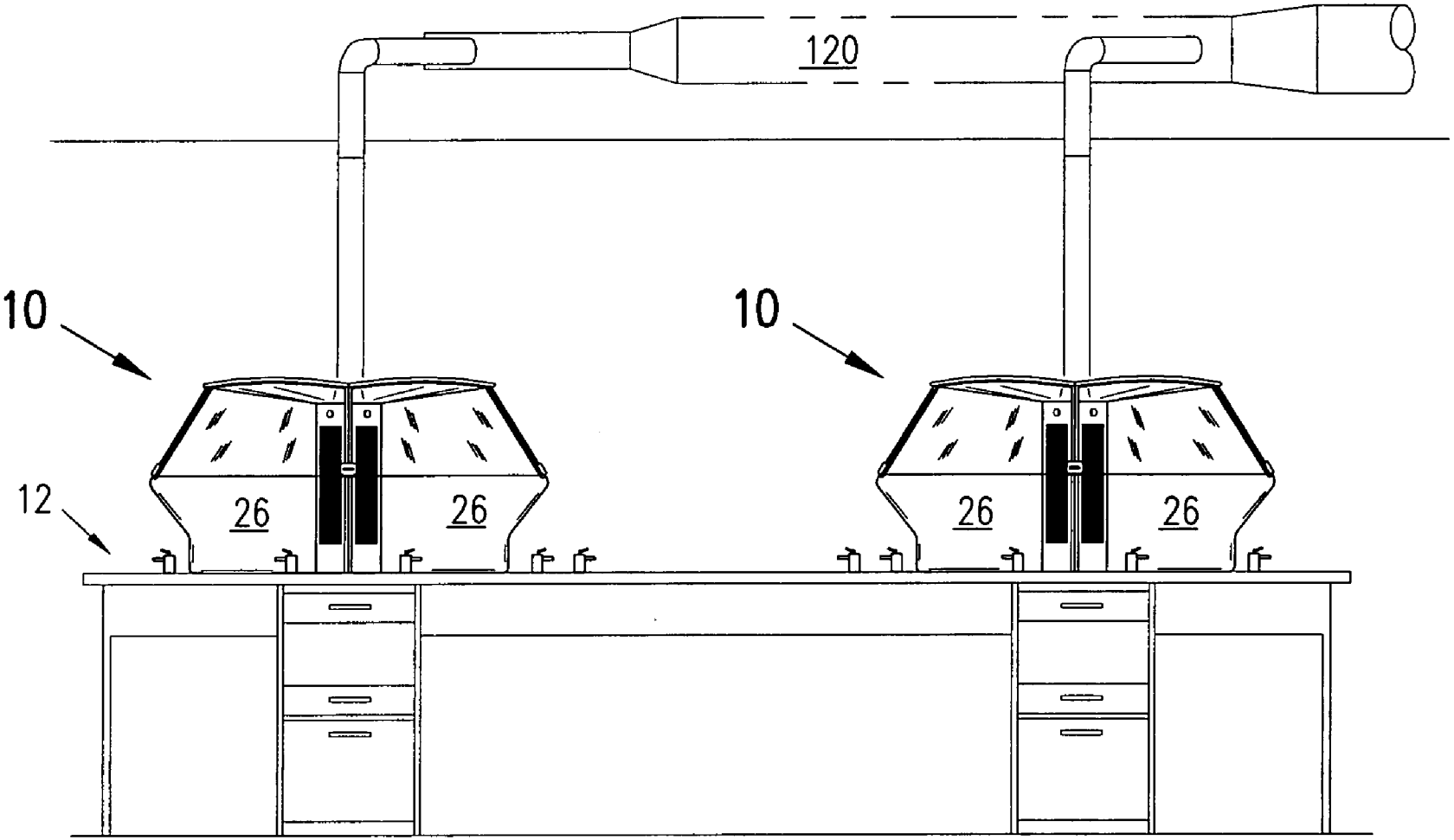
FIG. 14 is a front elevation view of a plurality of desktop-type ventilation systems according to the present invention connected to an overhead primary ventilation system.

Referring now to the figures, FIGS. 1, 6–9, 14 and 15 illustrate desktop-type ventilation system(s) 10 according to the present invention placed on work surface 12. Desktop-type ventilation system 10 broadly comprises at least one fume hood 14 and ventilation hub 16. Ventilation hub 16 is provided to connect one or more fume hoods 14 to primary ventilation system 120 (see FIG. 14), e.g., a primary ventilation system of a building or other air filtering system, such that an area of low pressure may be created under the fume hood. The area of low pressure tends to draw air into fume hood 14 and evacuates the air in the direction of the arrows (see FIGS. 6 and 7). In a preferred embodiment, ventilation hub 16 is detachably securable to work surface 12 and fume hoods 14 are detachably securable to the ventilation hub. Preferably, ventilation hub 16 is centrally disposed upon work surface 12, e.g. a desktop, and is connected to primary ventilation system 120 by means of lower ventilation coupling 18 (shown in FIG. 17 as comprising aperture 90). Alternatively, as illustrated in FIGS. 4*b* and 14, ventilation hub 16 may be secured to primary ventilation system 120 by means of upper ventilation coupling 20.

Referring specifically now to FIGS. 1–3, and 5–15, each of fume hoods 14 generally comprise front wall 22, rear wall 24, side walls 26 and top wall 28. In a preferred embodiment, rear wall 24, side walls 26 and top wall 28 are planar and flat whereas front wall 22 is arcuate and curved. Front wall 22, rear wall 24, side walls 26 and top wall 28 are detachably securable such that the desktop-type ventilation system 10 may be more conveniently shipped in an unassembled state. In a preferred embodiment, front wall 22 is detachably securable to side walls 26 and top wall 28. Front wall 22 serves as a viewing shield to allow individuals to view their work under the hood while simultaneously preventing/minimizing injury that may occur.

With the exception of front wall 22 and top wall 28, the walls of the fume hood are, preferably, wholly opaque and formed from heat, shock, and chemically resistant materials. In a preferred embodiment, opaque portions of walls are formed from a cellulose fiber reinforced phenolic resin core material, such as Trespa Athlon™, currently available from Trespa North America of California. It should be appreciated, however, that the specific materials from which the walls of the fume hood may be formed may vary according to the intended use of the desktop ventilation system, for example, metals, plastic, glass, fiberglass, resins, wood, or combinations thereof, etc.

Front wall (viewing shield) 22 is provided to prevent/minimize injury to individuals working under the fume hood and defines inlet orifice 30. Front wall 22 comprises front wall upper edge 32, front wall side edges 34, and front wall lower edge 36. Front wall upper edge and front wall lower edge 36 are arcuate and front wall upper edge 32 has a radius that is smaller than that of front wall lower edge. Front wall upper edge 32 is configured for receivable fit within arcuate groove 70 of top wall 28. Front wall side edges 34 are configured for receivable fit on rail support members 50 of side walls 26. In a preferred embodiment, front wall (viewing shield) 22 extends from the top of the fume hood to a position that is generally intermediate the vertical height of the fume hood. In a preferred embodiment, front wall (viewing shield) 22 is wholly transparent and formed from heat, shock, and chemically resistant materials, and more preferably, is formed from a lightweight, transparent acrylic or polycarbonate; it should be appreciated, however, that the specific materials from which front wall 22 may be formed may vary with intended use of the desktop ventilation system. Front wall (viewing shield) 22 is preferably molded to maintain an arcuate and outwardly sloping configuration. The arcuate and sloped nature of the front wall (viewing shield), which slopes outward from front wall upper edge 32 to front wall lower edge 36, tends to increase the work area under the fume hood and is believed to improve air flow, field of view/line of sight by reducing glare from various angles, and may promote the efficient and safe use of the fume hood (ergonomics). The arcuate and sloped nature of the front wall (viewing shield) also acts to increase the amount of light that is able to reach the work surface. While front wall (viewing shield) 22 is illustrated as being devoid of a sash member for substantially closing the front wall when not in use, the front wall may be configured to comprise such feature.

Side walls 26, along with rear wall 24, are provided for supporting top wall 28. Side walls 26 diverge with respect to one another from rear wall 24 to front wall (viewing shield) 22. The divergent configuration of side walls 26 acts to funnel air drawn into the fume hood toward ventilation hub 16 such that air is more efficiently and effectively evacuated from below the fume hood. Side walls 26 comprise side wall front edge 38, side wall rear edge 40, side wall bottom edge 42 and side wall top edge 44. Side wall front edge 38 comprises sloped portion 46, cutaway portion 48 and notch portion 49. The angle of sloped portion 46 generally correlates with the slope of front wall (viewing shield) 22. Proximate side wall front edge 38, near sloped portion 46 and disposed on the interior surface of the side walls, are rail support members 50. Rail support members 50 are provided to support front wall side edges 34 of front wall (viewing shield) 22. Cutaway portion 48 generally corresponds with the inlet orifice 30 and is generally provided to reduce the footprint of the fume hood and increase the area of the work space. Cutaway portion 48 also tends to promote more efficient and safe use of the fume hood (ergonomics), provide reductions in the weight of the fume hoods, and tends to increase the field of view/lines of sight to the work area such that individuals, e.g., instructors, may more effectively monitor the work area. Proximate the interface of sloped portion 46 and cutaway portion 48 is notch portion 49. Notch portion 49 is provided for receiving front wall fastener 51 (shown more clearly in FIGS. 11*a* and 11*b*), which is used to detachably secure the front wall (viewing shield) to the fume hood as well as side walls 26 of adjacent fume hoods to one another. Front wall fastener 51 may be secured to the side walls by means of screws, bolts or other appropriate fasteners, or may be held in place by a tension force, e.g., by oppositely directed forces of adjacent side walls. Side wall rear edge 40 is, preferably, beveled for detachable mating attachment with rear wall 24 and comprises one or more countersunk mating fasteners 52 for mate with fasteners 52 of rear wall 24. Preferred fasteners 52 comprise Mod-Eez™ type fasteners, currently available from Modular Systems, Inc. of Michigan. Other appropriate fasteners may be utilized. Side wall bottom edge 42 is generally provided for contacting a desktop or other work surface and may include rubber feet for preventing movement of the fume hood thereon. Side wall top edge 44 is generally provided for supporting top wall 28. Side wall top edge 44 slopes upward from the rear of the fume hood to the front of the fume hood (see FIGS. 7 and 8) and comprises appropriate fasteners for securing top wall 28.

Rear wall 24 is provided for securing the fume hood to ventilation hub 16 and includes outlet orifice 54, which in the embodiment illustrated, is shown as being rectangular in shape. Outlet orifice 54 corresponds to the rectangular shape of vent 76 of ventilation hub 16. Rear wall includes rear wall top edge 56, rear wall bottom edge 58, and rear wall side edges 60. Rear wall top edge 56 is provided for supporting top wall 28. Rear wall bottom edge 58 is provided for supporting the fume hood on a desktop or work surface and may comprise rubber feet. Rear wall side edges 60 are, preferably, beveled and include mating fasteners 52 for mate with fasteners 52 of side walls 26. Rear wall 24 further comprises fume hood fastening means 62, which generally comprises a handled threaded member for securing the fume hood to the ventilation hub. In the embodiment illustrated, rear wall 24 is shown as being planar such that it corresponds with the shape of ventilation hub 16; it should be appreciated, however, that rear wall 24 may be comprise other shapes that correspond with the shape of the ventilation hub, for example, the rear wall may be arcuately shaped to conform to the shape of a cylindrical ventilation hub. The width of rear wall 24 is generally less than that of front wall 22 such that side walls 26 connected thereto diverge with respect to one another from rear wall 24 to front wall 22.

Top wall 28 comprises top wall front edge 64, top wall rear edge 66 and top wall side edges 68. Preferably, top wall front edge 64 is arcuate and includes arcuate groove 70 on its interior surface. Arcuate groove 70 (See FIGS. 6 and 7) is provided for accepting front wall upper edge 32 of front wall (viewing window) 22 therein. Proximate and along the front edge are a series of orifices 72 for drawing air into the fume hood. Orifices 72 tend to draw air into the fume hood from above such that any air collecting under the fume hood near top wall 28, is evacuated. Top wall rear edge 66 generally corresponds with the width and shape of rear wall 24. Top wall side edges 68 diverge with respect to one another from top wall rear edge 66 to top wall front edge 64 and generally correspond with diverging side walls 26. Top wall 28 is configured to be secured to top edges 44 of side walls 26. Thus, top wall 28 is configured for directing and causing air to be funneled toward ventilation hub 16. While in a preferred embodiment the top wall is opaque, it may be configured to comprise a viewing window therein, or may comprise a wholly transparent material for allowing light to pass for illuminating the work area.

Referring more specifically now to FIGS. 1, 2, 4–9, and 14–17, ventilation hub 16 is provided for connecting the fume hoods to a primary ventilation system such that air may be evacuated from the fume hood(s) 14. Ventilation hub 16 broadly comprises ventilation core 74, which is configured for detachably securing lower ventilation coupling 18, upper ventilation coupling 20 and/or ventilation cover 75. In a preferred embodiment, ventilation core 74 is formed of stainless steel or other appropriate material and comprises at least one vent 76, which preferably comprises a screened material formed from stainless steel, and more specifically, 50–60% open mesh. Ventilation core 74 may also comprise threaded through-bores 80 and through-bores 82. Threaded through-bores 80 are provided for securing fume hood 14 to the ventilation hub by means of fume hood fastening means 62. Through-bores 82 are generally provided for passing threaded fasteners to secure lower ventilation coupling 18, upper ventilation coupling 20 and/or ventilation cover 75 to the ventilation core as may be desired.

Vents 76 are configured for insertion and substantial mating fit with outlet orifices 54 of rear walls 24. Where ventilation core 74 comprises a plurality of vents 76 and less than the plurality of fume hoods are secured to the to the ventilation hub, vents 76 may be closed utilizing an appropriately fitting cover, if desired. In a preferred embodiment, the area of vents 76 is large such that static pressure drops are lowered. As a result, the fume hoods may be safely operated using low velocity fans and blowers, which, preferably, draw air into the hood at velocities as low as 75 cubic feet per minute/hood. The ability of the ventilation system of the present invention to utilize low velocity fans lowers fume hood face velocities, noise levels and reduces the volume of air that is drawn into the fume hoods, which can result in significant cost savings with regard to heating/air conditioning.

Ventilation core 74 is adapted to receive channeling insert 78 therein, which acts to more efficiently and effectively draw air from within fume hood 14. In the embodiment illustrated, channeling insert 78 comprises a stainless steel screen that has a cross-sectional shape forming a cross. The cross structure forms individual air passages, one for each vent 76, within the ventilation core. It is believed that the channeling insert reduces turbulence with in the ventilation core. It should be appreciated that while channeling insert 78 is illustrated as having a cross-sectional shape in the form of a cross, the cross-sectional shape of the channeling insert will depend upon the number of vents 76 disposed in ventilation core 74. A further benefit provided by channeling insert 78 is that it tends to prevent individuals from viewing, through vents 76, work areas under other fume hoods that may be secured to ventilation hub 16. It should be appreciated that while ventilation core 74 is illustrated as comprising a rectangular parallelepiped, the ventilation core may be shaped otherwise, e.g., cylindrical, polygonal, etc., and its related components, e.g., upper and lower ventilation couplings, etc., may be correspondingly configured for mating fit therewith. In a cylindrical embodiment, channeling insert 78 may comprise a cross-sectional shape in the form of a cross, or may comprise an Archimedes screw-type device configured for rotation within ventilation core 74 under the force of air being forced therethrough, e.g., as by primary ventilation system 120.

Figure 15:
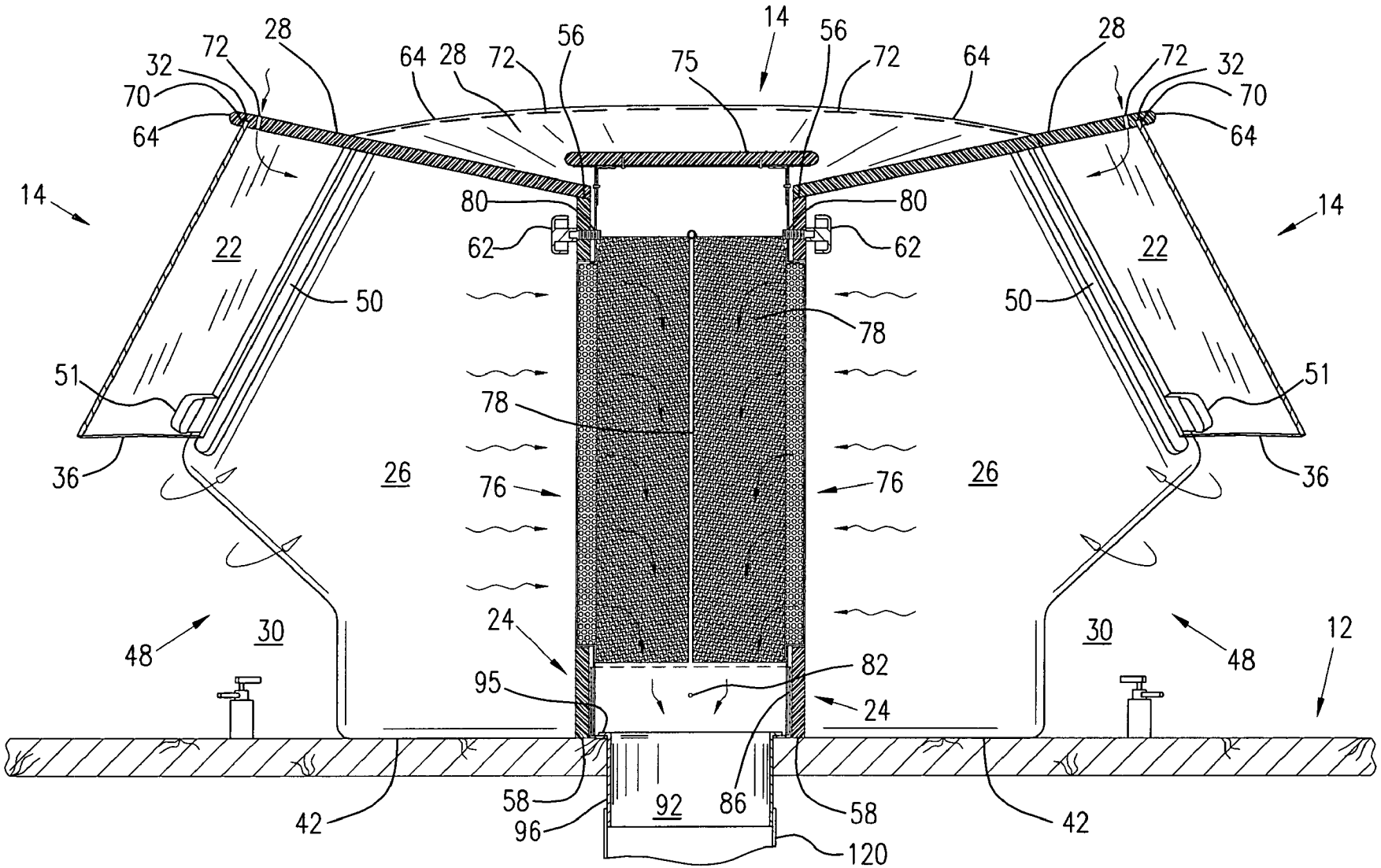
FIG. 15 is cross-section view of a fume hood according to the present invention a desktop-type ventilation system according to the present invention connected to a lower primary ventilation system passing through a work surface.
Figure 16:
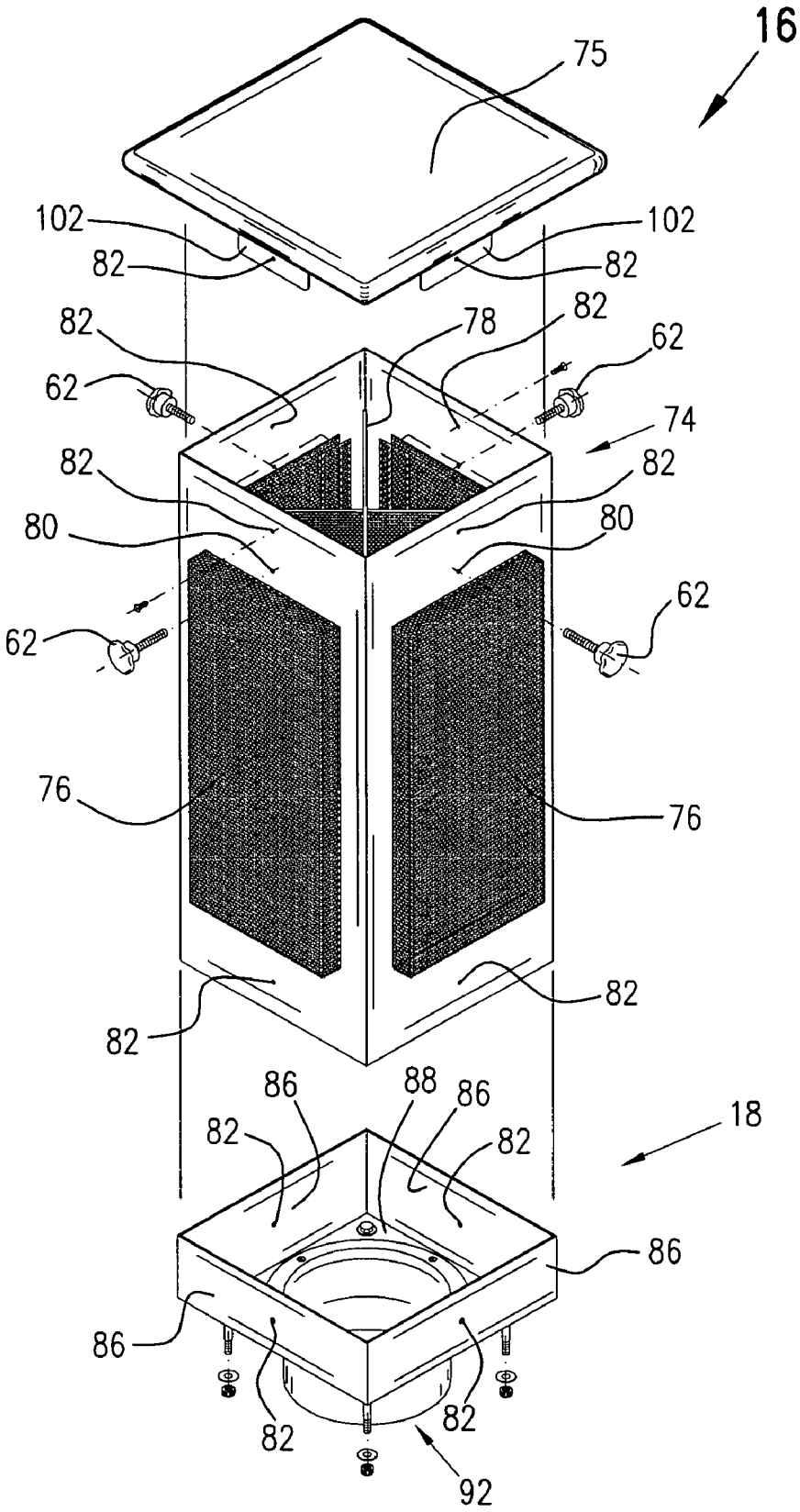
FIG. 16 is an exploded view of a ventilation hub according to the present invention.
Figure 17:
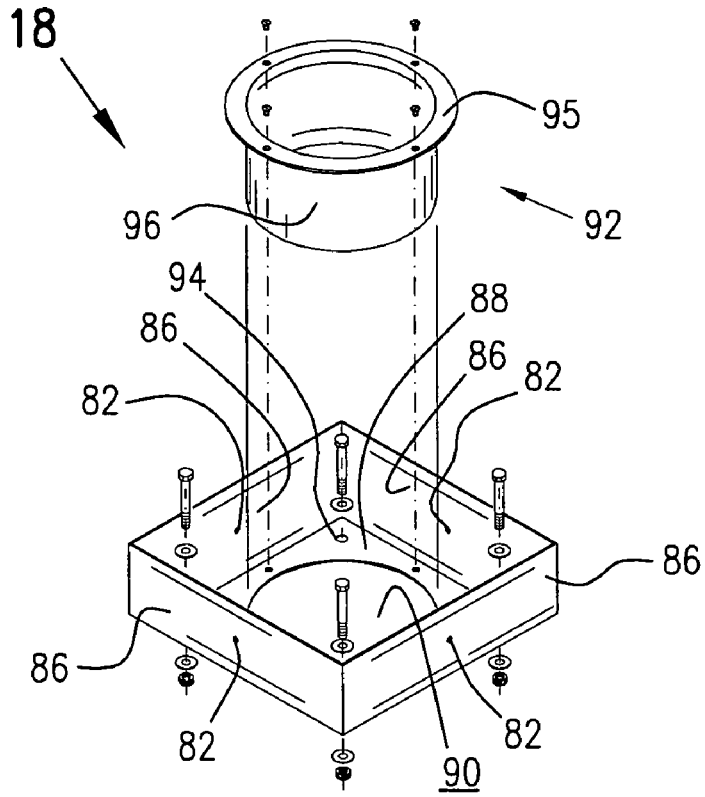
FIG. 17 is an exploded view of a lower ventilation coupling according to the present invention.
Figure 18:
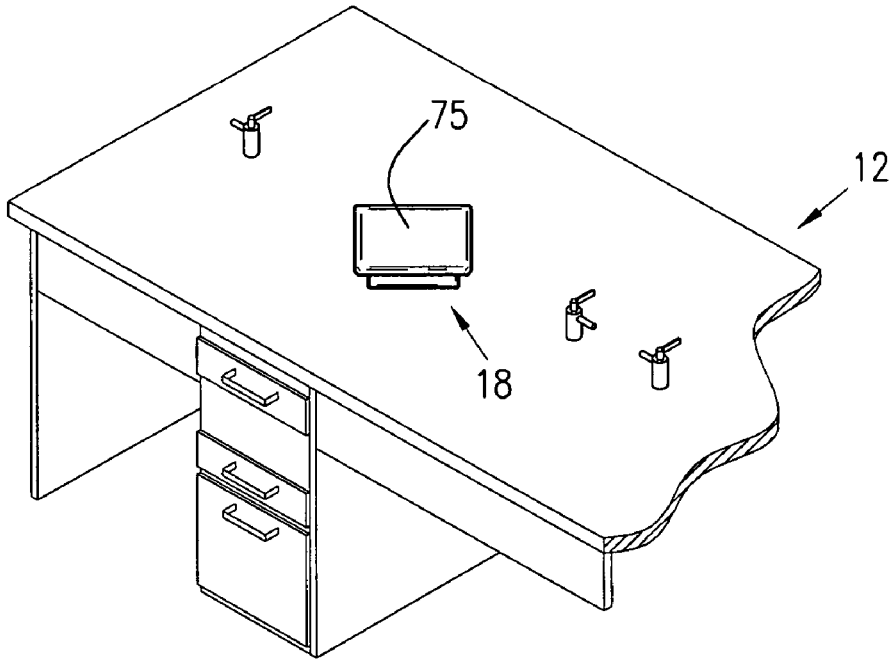
FIG. 18 is a perspective view illustrating a cover for covering a primary ventilation system duct when the desktop-type ventilation system of the present invention is not in use; and, FIG. 19 is a perspective view of a modular duct system for coupling a primary ventilation system to the desktop-type ventilation system of the present invention.

In a preferred embodiment, the desktop-type ventilation system of the present invention may be detachably mounted to primary ventilation system 120 that passes through a desktop or work surface (See FIGS. 15–18). In such instance, the desktop ventilation system may be secured to the primary ventilation system by means of lower ventilation coupling 18, which in this case comprises aperture 90. In such configuration, the upper end of ventilation core 74 may be closed off by ventilation cover 75. As illustrated in FIGS. 15–17, lower ventilation coupling 18 is fixed to a desktop or work surface and is configured for receiving ventilation core 74 thereon. Lower ventilation coupling 18 corresponds to the cross-sectional shape of ventilation core 74 and generally comprises sidewalls 86 and base plate 88. Base plate 88 comprises aperture 90 for accepting duct coupling 92 therein. Base plate 88 further comprises a plurality of through-bores 94 for securing the lower ventilation coupling to a desktop or work surface. Duct coupling 92 generally comprises annular ring portion 95 and duct receiving portion 96, which is configured for connection to a duct of a primary ventilation system or other filtering system. Annular ring portion 95 may be detachably secured to base plate 88 by appropriate fastening means. In a preferred embodiment, each of sidewalls 86 includes appropriate means for detachably securing ventilation core 74 thereto, for example, through-bores 82 for receiving threaded fasteners. When the ventilation hub is not in use, lower ventilation coupling 18 secured to a work surface may be closed off with ventilation cover 75 as shown in FIG. 18.

Figure 19:
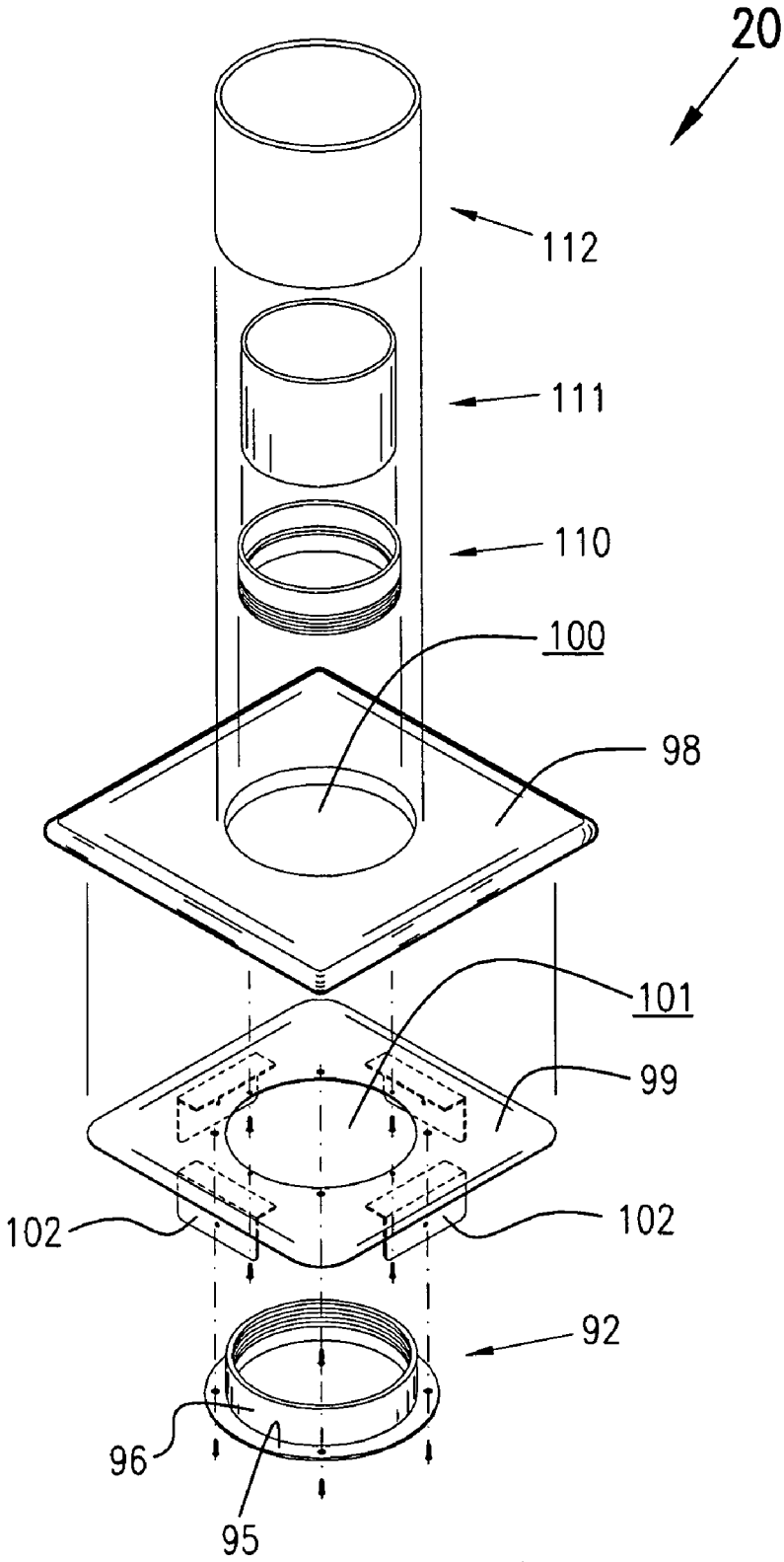

Alternatively, where ventilation of the fume hoods is to be provided by, for example, an overhead primary ventilation system, upper ventilation coupling 20 and lower coupling 18, which does not comprise aperture 90, may be utilized. As shown in FIGS. 4*a*, 4*b*, 7, 8 and 14, upper ventilation coupling 20 generally comprises upper plate 98, lower plate 99 and duct coupling 92. Upper plate 98 and lower plate 99 comprise apertures 100 and 101 for passing duct receiving portion 96 of duct coupling 92 therethrough. Annular ring portion 95 of duct coupling 92 may be detachably secured to upper plate 98 and lower plate 99 by appropriate fastening means. Upper plate 98 is, preferably made from Trespa Athlon™. Lower plate 99 is, preferably, formed from stainless steel and further comprises members 102 having through-bores 82 for securing the upper coupling to the ventilation core. Upper ventilation coupling 20 may also be configured to comprise one or more electrical outlets and/or illumination devices (not shown) for illuminating the work area under each fume hood. For example, upper ventilation coupling 20 may comprise four electrical outlets and/or four illumination devices where the desktop-type ventilation system comprises four fume hoods and the top walls 28 of each fume hood comprise a viewing window. As illustrated in FIG. 19, upper coupling 20 may also be configured for accepting duct coupling 92 comprising threaded duct receiving portion 96, for accepting threaded coupling 110. Threaded coupling 110 is adapted for mating fit with one or more modular ducts 111, which connect the ventilation system 10 with the primary ventilation system. Sleeve 112, which may comprise an aesthetically pleasing material such as stainless steel mesh, is provided for covering modular ducts 111.

Figure 12:
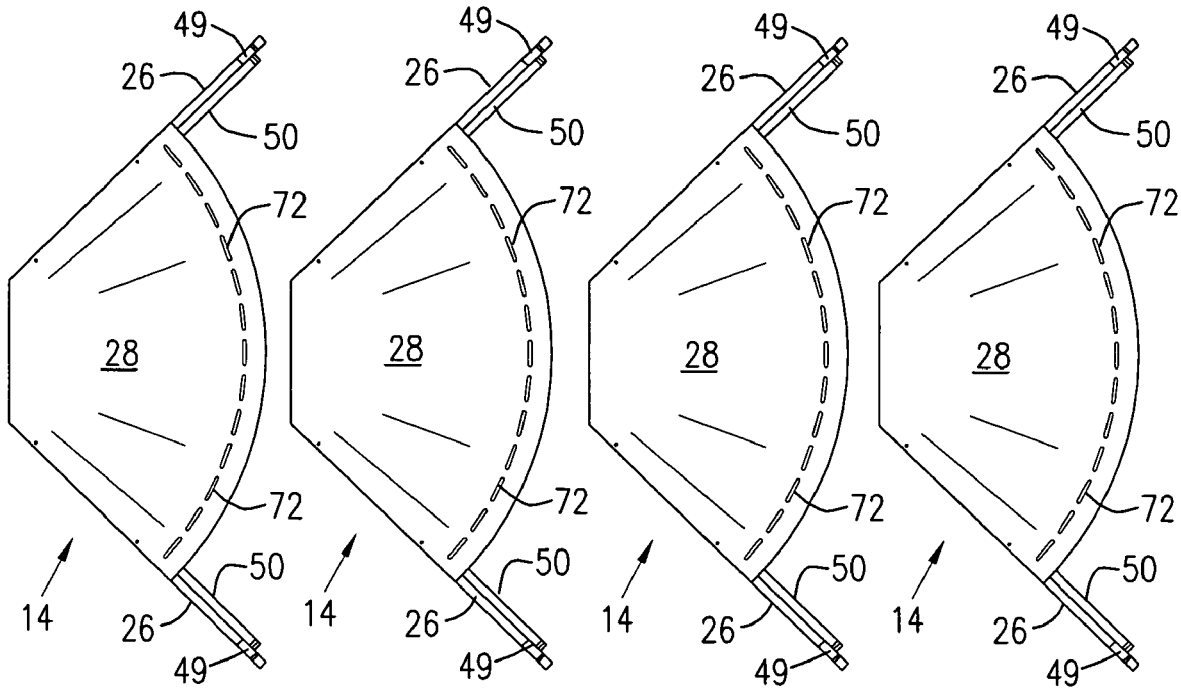
FIGS. 12 and 13 are top views of a plurality of fume hoods according to the present invention, with front walls removed, in a substantially broken down state and stacked for storage.
Figure 13:
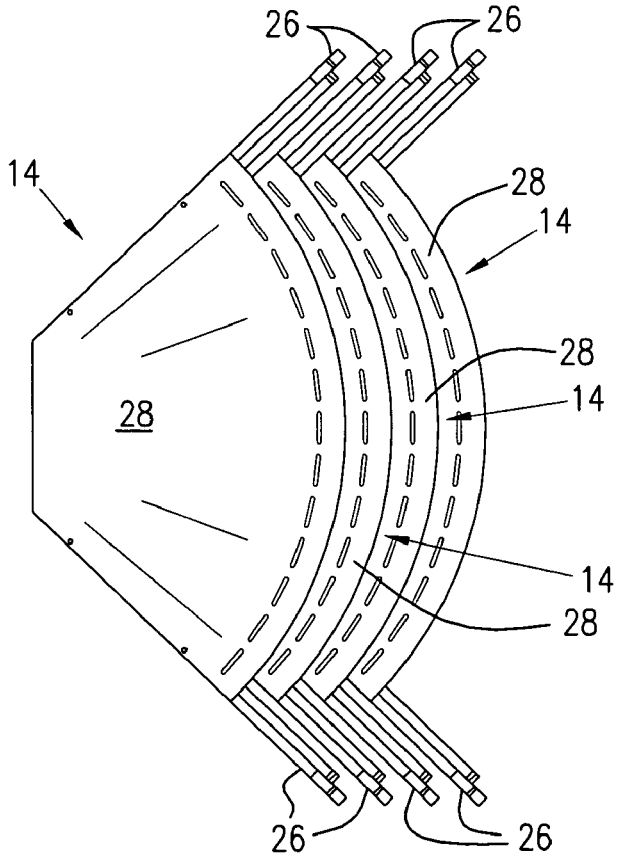

The present invention is generally configured to be easily set up and broken down after use. Where the desktop ventilation system is to be set up, after the rear, side, and top walls have been appropriately secured to one another by means of fasteners 52 after shipment, a user need merely secure ventilation hub 16 to a ventilation system utilizing lower ventilation coupling 18 or upper ventilation coupling 20 as may be appropriate. Thereafter, one or more fume hoods 14 (without front walls 22 attached) may be secured to the ventilation hub by means of fume hood fastening means 62 (shown more clearly in FIG. 10). Front walls 22 may then be secured to fume hoods 14 by means of front wall fastener 51 (shown more clearly in FIGS. 11*a* and 11*b*). Where a plurality of fume hoods are secured to the ventilation hub, the desktop-type ventilation system 10 comprises a pod, or cluster, of fume hoods utilizing a common connection to primary ventilation system 120 (See FIG. 14). Disassembly of the desktop ventilation system is generally the opposite of assembly. Generally, the first step is to remove front wall fasteners 51 such that front walls 22 may be removed. However, as illustrated in FIG. 12 and 13, after removal of the front wall disassembly of the rear, side, and top fume hood walls is not required because the structure they form is capable of being nested for convenient storage. After disassembly and when the desktop ventilation system is not in use, ventilation cover 75 (See FIGS. 18), may be used to close off any ducts leading to primary ventilation system 120.

Thus, it is seen that the objects of the present invention are efficiently obtained, although modifications and changes to the invention should be readily apparent to those having ordinary skill in the art, which modifications are intended to be within the spirit and scope of the invention as claimed.

What is claimed is:

1. A desktop-type ventilation system comprising:

a ventilation hub, said ventilation hub comprising at least one vent therein for the intake of air; and, at least one fume hood connected to said ventilation hub, said at least one fume hood comprising a front wall defining an inlet orifice, a rear wall comprising an outlet orifice for connection to said ventilation hub, a pair of side walls and a top wall, wherein each of said side walls diverge with respect to one another from said rear wall to said front wall and said top wall is disposed at an angle of elevation from said rear wall to said front wall;

wherein said front wall is detachably securable to said side walls and said top wall; and, wherein said front wall is arcuate and the radius of a top edge of said front wall is smaller than a radius of a lower edge of said front wall such that said front wall slopes outward from said top edge to said lower edge.

2. A desktop-type ventilation system comprising:

at least one fume hood comprising a rear wall comprising an outlet orifice for connection to a ventilation system, a pair of side walls and a top wall, wherein each of said side walls diverge with respect to one another from said rear wall and said top wall is disposed at an angle of elevation from said rear wall;

wherein said fume hood further comprises a front wall defining an inlet orifice, said front wall detachably securable to said side walls and said top wall; and, wherein said front wall is arcuate and the radius of a top edge of said front wall is smaller than a radius of a lower edge of said front wall such that said front wall slopes outward from said top edge to said lower edge.

3. The desktop-type ventilation system of claim 1 wherein said rear wall is detachably securable to said ventilation hub.

4. The desktop-type ventilation system of claim 1 wherein said ventilation hub is detachably securable to a work surface.

5. The desktop-type ventilation system of claim 2 comprising a plurality of fume hoods detachably secured to a ventilation hub.

6. The desktop-type ventilation system of claim 3 wherein said ventilation hub is detachably securable to a primary ventilation system and a work surface.

* * * * *